United States Patent [19]

Koncelik et al.

[11] 4,449,768

[45] May 22, 1984

[54] SHIELD CONNECTOR

[75] Inventors: Kenneth J. Koncelik, Brook Park; Erwin H. Goetter, Chesterland, both of Ohio

[73] Assignee: Preformed Line Products Company, Mayfield Village, Ohio

[21] Appl. No.: 286,335

[22] Filed: Jul. 23, 1981

[51] Int. Cl.[3] ..... H01R 4/66

[52] U.S. Cl. ..... 339/14 R; 339/97 R

[58] Field of Search ..... 339/95 R, 97 R, 96, 339/14 R, 14 L; 174/78, 88 R, 88 B

[56] References Cited

U.S. PATENT DOCUMENTS

| | | | |
|---|---|---|---|
| 2,437,339 | 3/1948 | Webster | 339/95 R |
| 3,499,972 | 3/1970 | Smith | 174/88 |
| 3,676,836 | 7/1972 | Gillemot et al. | 339/97 R |
| 3,701,839 | 10/1972 | Smith | 174/78 |
| 3,753,204 | 8/1973 | Thompson et al. | 339/14 R |
| 3,778,749 | 12/1973 | Kapell | 339/97 R |
| 3,915,540 | 10/1975 | Thompson et al. | 339/95 R |
| 4,026,619 | 5/1977 | Gillemot | 339/95 R |
| 4,310,209 | 1/1982 | Fleming et al. | 339/97 R |

*Primary Examiner*—John McQuade
*Assistant Examiner*—P. Austin
*Attorney, Agent, or Firm*—Fay & Sharpe

[57] ABSTRACT

A shield connector for shielded cable includes inner and outer plates having an intermediate plate interposed therebetween. The inner and intermediate plates have penetration projections thereon for penetrating a sheath positioned therebetween when the plates are clamped together. The outer plate is constructed of spring metal and is resiliently deformed when all of the plates are clamped together by a fastener device.

14 Claims, 4 Drawing Figures

SHIELD CONNECTOR

BACKGROUND OF THE INVENTION

This application relates to the art of connectors and, more particularly, to shield connectors for use with shielded cable.

One type of conventional electrical cable, such as telephone cable, includes a bundle of electrical conductors surrounded by a shield of metal foil or braid which, in turn, is surrounded by a protective plastic sheath or jacket. The grounded metal shield eliminates interference in the conductors during use thereof. Continuity of the metal shield must be insured at splice points and terminals to protect the conductors against interference.

Continuity of the metal shield is commonly maintained at splice points and terminals by the use of shield connectors of various types. Shield connectors commonly include inner and outer plates, with the inner plate being positioned between the cable bundle and the metal shield and with the outer plate positioned against the outer surface of the plastic sheath in opposed relationship to the inner plate. A conductive metal strap is positioned beneath the outer metal plate for connection to a terminal end portion of another cable at a splice or for connection to another device at a terminal. The plates are clamped together by fastener means and the inner plate has sharp projections which bite into the metal shield. This establishes a good conductive path from the metal shield to the inner plate through the fastener means and outer plate to the conductive strap. Two prior shield connector arrangements are shown in the commonly assigned U.S. Pat. Nos. 3,499,972 and 3,701,839 to Smith.

Shield connectors are subject to mechanical failure under stress if they do not adequately grip the metal shield, plastic sheath and conductive strap. These connectors also fail electrically because of a poor electrical connection between the inner plate and the metal shield or between the outer plate and the conductive strap.

Therefore, it has been considered desirable to develop a shield connector construction which would provide a highly reliable electrical and mechanical connection to the metal shield of an associated electrical cable. The subject invention relates to a new and improved shield connector which successfully meets the foregoing needs and others.

SUMMARY OF THE INVENTION

In accordance with the invention, a shield connector is provided which includes inner and outer plates respectively positioned on the inner and outer sides of a cable metal shield. The inner plate has shield penetration means projecting therefrom toward the outer plate for penetrating the cable shield when the plates are clamped together. The outer plate includes a generally plane main portion having opposite legs extending therefrom toward the inner plate for normally maintaining the main portion in spaced relationship relative to the inner plate and the outer surface of the cable plastic sheath. The outer plate is made of spring metal and fastener means for clamping the plates together is located for cooperation with the main portion of the outer plate to resiliently bow same inwardly between its legs toward the inner plate. The stress in the main portion of the outer plate resiliently biases the legs toward the inner plate. This arrangement maintains constant pressure between all parts of the connection notwithstanding temperature variations. This insures good electric contact during all field environmental conditions including fault currents, current surges, temperature variations and chemical exposures.

According to another aspect of the invention, an intermediate plate is positioned between the inner and outer plates. More specifically, the intermediate plate is positioned beneath the outer plate and against the outer surface of the cable plastic sheath. The conductive strap for spanning a splice or connection to a terminal is positioned between the outer and intermediate plates. The intermediate plate includes penetration means projecting toward the inner plate for penetrating both the plastic sheath and the metal shield. Thus, the cable metal shield is penetrated from opposite sides by the penetration means on both the inner and intermediate plates. This establishes a highly reliable electrical connection with the metal shield and also provides a good electrical connection to the metal strap.

In accordance with another aspect of the invention, one end of the inner plate is rounded and is bent upwardly toward the intermediate plate. The intermediate plate has a substantially flat end portion in aligned opposition to the rounded end on the inner plate. When the plates are clamped together by the fastener means, the rounded end on the inner plate penetrates the metal shield and also securely grips same for insuring good electrical and mechanical connections. The end portion of the intermediate plate opposite from the flat end portion thereof is arcuately curved to generally correspond with the curvature of the cable and the shield penetration means is located on this curved end portion.

The outer metal plate is positioned with the legs thereof extending transversely to the longitudinal axis of the cable and with the legs at the opposite ends of the outer plate being spaced along the cable axis. The intermediate plate is also positioned with its arcuately curved and flat end portions extending transversely of the cable longitudinal axis with the flat end portion being spaced further from the terminal end of the cable than the arcuately curved portion. Likewise, the upwardly bent portion of the inner plate which has the rounded end is spaced further from the cable terminal end than the opposite end. Also, the upwardly bent portion is located in opposed cooperative relationship with the flat end portion of the intermediate plate.

It is a principal object of the present invention to provide a new and improved shield connector.

It is also an object of the present invention to provide a new and improved shield connector having an intermediate plate which insures a good mechanical and electrical connection between the connector and a metal strap, and between the connector and the cable shield and sheath.

An additional object of the invention resides in a new and improved shield connector having an outer plate comprised of spring metal for maintaining a resilient bias on all of the component parts to insure a good mechanical and electrical connection during all shield environmental conditions including fault current, current surges, temperature variations and chemical exposures.

A still further object of the invention is the provision of a shield connector having an improved inner plate with an upwardly bent end portion having a rounded end which penetrates and grips a cable metal shield in such a manner that a good mechanical and electrical connection is insured.

Still other objects and advantages for the invention will become apparent to those skilled in the art upon a reading and understanding of the following specification.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof.

DESCRIPTION OF A PREFERRED EMBODIMENT

Figures 1, 2, 3, 4:
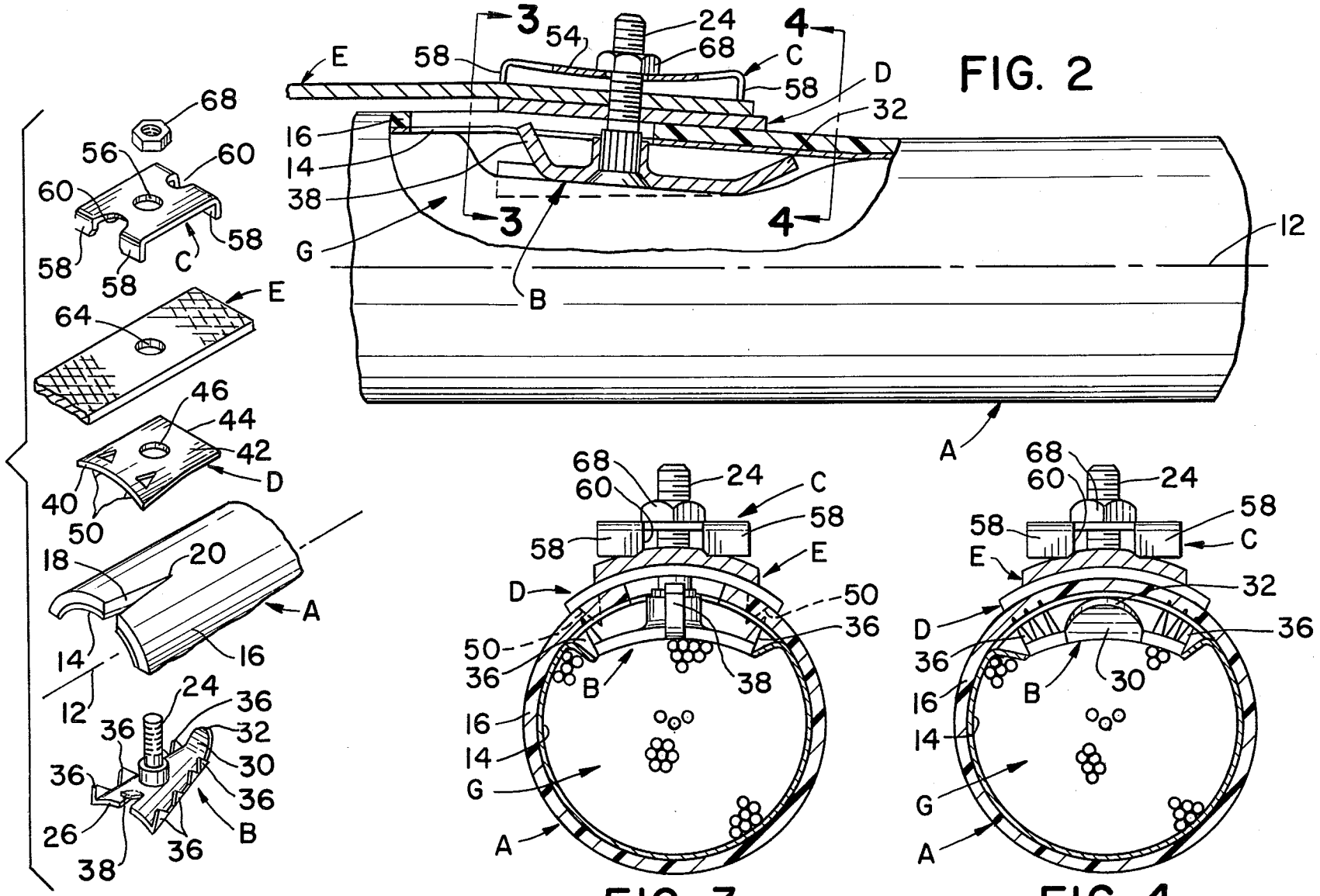
FIG. 1 is an exploded perspective view of a shield connector constructed in accordance with the present invention.
FIG. 2 is a cross-sectional view taken longitudinally through a shield connector constructed in accordance with the present application showing the relationship between the component parts in a mounted relationship on an associated cable.
FIG. 3 is an end elevational view taken generally along lines 3—3 of FIG. 2; and, FIG. 4 is an end elevational view taken generally along lines 4—4 of FIG. 2 with a portion of the cable broken away for ease of illustration.

Referring now to the drawings wherein the showings are for purposes of illustrating a preferred embodiment of the invention only and not for purposes of limiting same, FIG. 1 shows the outer protective covering of an electrical cable A having a longitudinal axis 12. The covering of electrical cable A includes a thin shield 14 of metal foil or braid which surrounds a bundle of electrical conductors, each of which is encased in dielectric material. Metal shield 14 is commonly provided with a thin polymer coating for protecting same against corrosion or chemical deterioration. Metal shield 14 is surrounded by a substantially thicker cylindrical sheath 16 of suitable flexible synthetic plastic material. A longitudinal split 18 is included in metal shield 14 and plastic sheath 16 with the split terminating at an innermost end 20. It will be recognized that it would be possible to make a shield connection by means other than longitudinal split 18; however, use of such alternative means does not in any way depart from the present invention.

With primary reference to FIG. 1 and secondary reference to FIGS. 2, 3 and 4, the subject new shield connector is comprised of a metal inner plate B, an outer plate C and an intermediate plate D. Inner metal plate B is constructed from metal and has a substantially centrally located threaded bolt 24 suitably staked or otherwise secured thereto to extend upwardly therefrom for reception through split or hole 18. The inner plate is substantially triangular in plan view so that its outer end 26 is substantially wider than an opposite bend line for an upwardly bent inner end portion 30 having a transversely rounded end 32 The inner plate is transversely arcuately curved so as to generally correspond with the curvature of metal shield 14. Penetration means for penetrating metal shield 14 is defined by a plurality of sharp teeth 36 projecting outwardly from the opposite side edges of the inner plate toward the outer surface of cable A.

An upwardly bent tang 38 adjacent outer or front end 26 of plate B may define an additional projection for penetrating and gripping metal shield 14. Projection 38 also may firmly engage an outer plate to provide a good electrical connection and may grip a conductive strap when the device is used with only a single outer plate.

The outer plate C and intermediate plate D are positioned on the outer side of metal shield 14 adjacent the outer surface of plastic sheath 16. Plates B, C and D are positioned in substantially radial alignment for cooperation with one another. Intermediate plate D has an arcuately curved outer end 40 which is curved to generally correspond with the curvature of the outer surface of plastic sheath 16. Intermediate plate D is also arcuately curved over the portion thereof adjacent to outer end 40 and then merges smoothly into a substantially flat portion 42 adjacent a straight inner end 44. A suitable central hole or opening 46 extends through this plate to receive threaded bolt 24 on inner plate B. The intermediate plate is also provided with penetration means in the form of teeth 50 struck therefrom in the curved area thereof and projecting toward inner plate B. Teeth 50 have a sufficient length to penetrate both plastic sheath 16 and metal shield 14 when the plates are clamped together. Teeth 50 are located in such fashion that they penetrate metal sheath 14 at locations spaced inwardly from teeth 36 on inner plate B. Moreover, flat portion 42 is located in opposition to rounded end 32 on upwardly bent end portion 30 of inner plate B.

Outer plate C is made of spring metal, such as spring steel, and includes a generally rectangular and planar main portion 54 having a central hole or opening 56 therethrough for receiving bolt 24. Integral legs 58 project downwardly from the opposite ends of main portion 54 and a pair of legs 58 is included at each opposite longitudinal end of main portion 54. The legs of each pair are, in turn, separated from each other by a notch 60 which also extends into planar main portion 54. This facilitiates some resilient deflection of the main portion generally along a longitudinal line connecting notches 60 at the opposed ends thereof as well as resilient bending of the main portion itself in a direction perpendicular to such line.

An electrically conductive metal strap E is provided for spanning a splice or for connection to a terminal. Strap E has an end portion positionable between outer plate C and intermediate plate D. A suitable opening 64 is provided in the end portion of strap E for receiving bolt 24 on inner plate B.

Once all of the parts are assembled and with particular reference to FIGS. 2, 3 and 4, a nut 68 is threaded onto bolt 24 and securely tightened. This bows main portion 54 inwardly between legs 58 (FIG. 2) so that the bending stress in the main portion maintains legs 58 in firm engagement with the end portion of conductive strap E. When the nut is tightened, teeth 36, 50 also penetrate metal shield 14 and grip same (FIGS. 3 and 4). The same is true for rounded sharp end 32 on inner plate B. This arrangement makes it possible to maintain a constant pressure between all of the components even during temperature variations.

The shield connector is applied to a terminal end portion of a cable A by first forming a split or hole 18 through metal shield 14 and plastic sheath 16. Inner metal plate B is then forced between metal shield 14 and the conductor bundle surrounded thereby so that bolt 24 extends upwardly through the split or hole. Intermediate metal plate D is then positioned against the outer surface of plastic sheath 16 with bolt 24 extending through hole 46. Conductive strap E may then be positioned against intermediate plate D with bolt 24 extending through strap hole 64. Outer metal place C is next positioned so that the terminal ends of legs 58 bear against conductive strap E and bolt 24 extends through hole 56. Nut 68 is then applied to bolt 24 and tightened for clamping all of the plates together and bowing flat main portion 54 of outer plate C inwardly.

The foregoing arrangement securely clamps all of plates B, C and D together and causes the penetration means defined by teeth 36 on inner plate B and by teeth 50 on intermediate plate D to penetrate metal shield 14. Metal shield 14 is thus penetrated both from the inside and the outside surfaces thereof. In addition, the relatively sharp end 32 on upwardly bent end portion 30 of inner plate B cooperates with flat end portion 42 on intermediate plate D to penetrate and grip metal shield 14 (FIG. 2). In fact, sharp, rounded end 32 may penetrate completely through metal shield 14 and grip plastic sheath 16. Flat portion 42 of intermediate plate D also provides a flat platform against which conductive strap E is clamped by the rear or inner legs 58 on outer plate C.

Referring again to FIG. 1, outer plate C is positioned with the opposite longitudinally spaced ends thereof extending transversely of cable axis 12. These opposed ends which include legs 58 are spaced apart from each other along axis 12. Opposite ends 40, 44 of intermediate plate D extend transversely of axis 12 and are similarly spaced axially therealong. The same relationship is true for inner plate B. Arranging the inner end portion of intermediate plate D to be substantially flat as at 42 provides a stress concentration because essentially line contact is made with the cable. This insures good penetration and gripping action for sharp rounded end 32 on the bent end portion of inner plate B.

Bolt 24 and nut 68 define fastener means for clamping all of the plates together. This fastener means is located relative to planar main portion 54 on outer plate C in a manner such that the main portion is bowed inwardly when the fastener means is tightened for clamping the plates together and causing the penetration means to penetrate and grip the metal shield or plastic sheath. For ease of illustration, the bundle of electrical conductors surrounded by metal shield 14 and plastic sheath 16 has been generally indicated in FIGS. 2, 3 and 4 by the letter G.

The arrangement and construction of the subject new and improved shield connector as detailed above provides a good current path to metal sheath 14 through both inner and intermediate plates B, D. In addition, both of these plates mechanically grip metal shield 14 and plastic sheath 16. A good electrical connection is provided to metal strap E through intermediate plate D and outer plate C.

The invention has been described with reference to a preferred embodiment. Obviously, modifications and alterations will occur to others upon the reading and understanding of this specification. It is intended to include all such modifications and alternations insofar as they come within the scope of the appended claims or their equivalents.

Having thus described the invention, it is now claimed:

1. In a shield connector for shielded cables, said connector being of the type including inner and outer metal plates respectively positionable on inner and outer sides of a cable shield, said inner plate having shield penetration means projecting therefrom toward said outer plate for penetrating a cable shield when said plates are clamped together, said outer plate including a generally planar main portion having opposite legs extending therefrom for normally maintaining said main portion in spaced relationship relative to said inner plate, and adjustable fastener means for clamping said plates together on opposite sides of a cable shield, the improvement comprising:

an intermediate plate positioned between said outer plate and the outer surface of the cable shield, said intermediate plate being engageable by said legs on said outer plate and having penetration means extending therefrom toward said inner plate for penetrating a cable sheath when said plates are clamped together, said intermediate plate having opposite end portions which extend transversely of the longitudinal axis of a cable on which said connector is used, one of said end portions being substantially flat and the other of said end portions being arcuately curved to generally correspond with the curvature of the cable.

2. The improvement as defined in claim 1 wherein said sheath penetration means on said intermediate plate is on said curved end portion thereof.

3. The improvement as defined in claim 1 wherein said inner plate has a rounded end on an end portion which is bent toward said intermediate plate in alignment with said flat end portion thereof, whereby said rounded end is opposed by said flat end portion to penetrate and grip a cable sheath when said plates are clamped together.

4. The improvement as defined in claim 1 wherein said outer plate is made of spring metal and said fastener means acts on said main portion of said outer plate to resiliently bow said main portion inwardly between said legs toward said intermediate plate.

5. The improvement as defined in claim 4 wherein said fastener means includes a threaded stud secured to said inner plate and extending through holes in said intermediate and outer plates and a nut on said stud on the outside of said outer plate, said hole in said outer plate being substantially centrally located in said main portion thereof.

6. A shield connector comprising:

inner and outer plates having an intermediate plate interposed therebetween, at least one of said inner and intermediate plates having penetration means projecting therefrom for penetrating a sheath positioned therebetween when said plates are clamped together, said intermediate plate having opposite end portions which extend transversely of the longitudinal axis of a cable on which said connector is used, one of said end portions being substantially flat and the other of said end portions being arcuately curved transversely thereof to generally correspond with the curvature of the cable, and fastener means for clamping said plates together.

7. The connector as defined in claim 6 wherein said inner plate has a transversely rounded end on an end portion which is bent toward said intermediate plate, said rounded end on said inner plate and said flat end portion on said intermediate plate being aligned in opposed relationship so that said rounded end penetrates and grips a sheath when said plates are clamped together.

8. The connector as defined in claim 6 wherein said outer plate is of spring metal and includes a generally planar main portion having opposite legs extending therefrom toward said intermediate plate for engaging said intermediate plate and normally maintaining said main portion spaced from said intermediate plate, said fastener means cooperating with said main portion when said plates are clamped together for resiliently bowing said main portion inwardly between said legs toward said intermediate plate.

9. The connector as defined in claim 6 wherein both of said inner and intermediate plates have penetration means thereon for penetrating a sheath positioned therebetween when said plates are clamped together.

10. A shield connector for shielded cables including inner, intermediate and outer metal plates, said inner metal plate being positionable on the inner side of a cable shield, said outer and intermediate metal plates being positionable on the outer side of a cable shield with said intermediate metal plate located beneath said outer metal plate, said inner plate having shield penetration means projecting therefrom toward said intermediate plate for penetrating a cable shield when said plates are clamped together, said outer plate including a generally planar main portion having opposite legs extending therefrom toward said intermediate plate for normally maintaining said main portion in spaced relationship relative to said intermediate plate, said intermediate plate having an arcuately curved portion adjacent one end thereof and being substantially flat adjacent the opposite end thereof, adjustable fastener means for clamping said plates together on opposite sides of a cable shield, said outer plate being of spring steel and said fastener means being located for cooperation with said main portion of said outer plate to resiliently bow same inwardly between said legs toward said inner plate whereby said legs are resiliently biased toward said inner plate under action of the bending stress in said main portion.

11. The improvement as defined in claim 10 wherein said intermediate plate has sheath penetration means extending therefrom toward said inner plate for penetrating a cable sheath when said plates are clamped together.

12. The improvement as defined in claim 11 wherein said sheath penetration means on said intermediate plate is located in said arcuately curved portion thereof.

13. The improvement as defined in claim 10 wherein said inner plate has a rounded end on an end portion which is bent upwardly toward said outer plate for penetrating and gripping a cable sheath.

14. The improvement as defined in claim 13 wherein said substantially flat end portion of said intermediate plate is generally aligned with said rounded end on said inner plate.

* * * * *